United States Patent [19]

Barrington

[11] 4,116,272

[45] Sep. 26, 1978

[54] SUBSEA TEST TREE FOR OIL WELLS

[75] Inventor: Burchus Q. Barrington, Duncan, Okla.

[73] Assignee: Halliburton Company, Duncan, Okla.

[21] Appl. No.: 808,491

[22] Filed: Jun. 21, 1977

[51] Int. Cl.[2] ..... E21B 33/035; E21B 43/12

[52] U.S. Cl. ..... 166/340; 166/53; 166/363; 166/321; 251/1 R

[58] Field of Search ..... 166/0.5, 250, 264, 315, 166/321, 53, 0.6, 319; 251/1 R, 1 B, 1 A

[56] References Cited

U.S. PATENT DOCUMENTS

| | | | |
|---|---|---|---|
| Re. 27,464 | 8/1972 | Taylor, Jr. | 166/0.5 |
| 3,823,773 | 7/1974 | Nutter | 166/250 |
| 3,858,649 | 1/1975 | Wray et al. | 166/264 |
| 3,860,066 | 1/1975 | Pearce et al. | 166/72 |
| 3,860,069 | 1/1975 | Wray et al. | 166/264 |
| 3,886,967 | 6/1975 | Nelson | 166/322 |
| 3,910,352 | 10/1975 | Mott | 166/315 |
| 3,967,647 | 7/1976 | Young | 166/0.5 |

*Primary Examiner*—Ernest R. Purser

*Attorney, Agent, or Firm*—Floyd A. Gonzalez; John H. Tregoning

[57] ABSTRACT

A hydraulically operated subsea test tree is disclosed for placement in a blowout preventer stack position on a sea floor above an oil well wherein fluid pressure from one side a set of rams is directed to a first side of a ball valve operating piston, and fluid pressure on the second side of said operating piston is directed to an area on the other side of the set of rams. By closing the rams and applying fluid pressure to the one side of the rams, the ball valve is moved from the closed to the opened position. Tandem ball valves are disclosed, each of which are hydraulic pressure operated to open, and spring operated to close such that the ball valves close when pressure on either side of the blowout preventer rams is equalized. A quick release is also disclosed which operates to release a stinger from a conduit leading to the surface when pressure is applied to one side of a second set of closed rams above the pressure which exists in the annulus exterior of the quick release mechanism. A means is also disclosed for varying the spacing between passageway inlets to accommodate for variations in blowout preventer stack designs.

39 Claims, 9 Drawing Figures

SUBSEA TEST TREE FOR OIL WELLS

BACKGROUND OF THE INVENTION

This invention relates to a control valve such as a subsea test tree for use in a submerged oil well, said test tree control valve adapted to be positioned within a subsea blowout preventer stack for controlling the flow of fluids through a testing string located in an offshore oil well during a production test or the like.

During the testing of offshore wells it is desirable to include in the testing string a control valve which is positioned in the vicinity of a blowout preventer stack. This blowout preventer stack normally rests on the sea floor with the control valve located in the stack for controlling oil well fluids through the testing string.

These test tree control valves are preferably operated using hydraulic pressure to actuate tandem valves for opening and closing the flow path through the valve apparatus. It has been the practice in the past to include hydraulic lines lowered from the surface of the sea to supply operating hydraulic fluid to control the tandem valves. For instance, such control valves have been disclosed in U.S. Reissue Pat. No. Re. 27,464 to Taylor reissued Aug. 22, 1972 and U.S. Pat. No. 3,967,647 to Young issued July 6, 1976. These control devices may include separate hydraulic fluid control lines, or concentric tubing strings extending from the control device to the surface.

Separate hydraulic fluid supply lines may be caught on obstructions beneath the surface of the water and are particularly troublesome when the testing string must be rotated to set the packer mechanism at the lower end of the testing string. In this case, the hydraulic fluid control lines wrap around the testing string extending from the control apparatus to the surface of the ocean.

Concentric tubing strings are also difficult to handle and to assemble as the testing string is lowered into the well.

The present invention provides a subsea oil well testing control valve wherein hydraulic fluid is provided by pressuring the well annulus below closed blowout preventer rams. The supplying of hydraulic pressure to operate the test tree valve in this manner eliminates separate hydraulic control lines or devices such as concentric tubing strings. A control line is used which is presently in place and available and which does not need to be rotated as the packer mechanism at the lower end of the testing string is set. The apparatus of the present invention includes tandem bal valves which are moved to the open position by hydraulic pressure supplied to the well annulus below a closed set of blowout preventer rams.

A separate fluid passageway is provided through the tool to provide operating control pressure transmitted to the tandem ball valves from the well annulus below a closed set of blowout preventer rams. A separate exhaust passageway is provided for setting a reference pressure in the subsea control apparatus and for exhausting hydraulic fluid to a position above the closed blowout preventer rams for allowing operation of the tandem ball valves. A quick release mechanism is also provided which allows for quickly releasing the testing string conduit above the control valve apparatus by applying well annulus pressure to below a separate set of closed blowout preventer rams. The quick release mechanism may also be operated by lifting the testing string from the surface and unscrewing from the test tree the conduit which extends from the control valve to the surface.

Release of well annulus pressure causes the tandem ball valves to reclose by spring actuating forces. The tandem ball valves are arranged such that the valves are operated independently. Thus, if one valve is prevented from closing, the second valve shall continue to close under operation of an independent ball closing mechanism.

A hydraulic reservoir section is present in the apparatus such that hydraulic fluid supplied to the tandem ball valves may be isolated from fluid appearing in the well annulus. Thus, the tandem ball valves are operated by a clean hydraulic fluid which is not contaminated by well annulus fluid.

The blowout preventer stack may vary in design and spacing from well to well. For this reason, means are provided in the invention for varying the control passageway access spacing to match the spacing of the rams used in conjunction with the control valve apparatus.

The tandem ball valves of the invention disclosed may be moved to the open position by applying fluid pressure to the well annulus below the closed rams of the blowout preventer stack, and then subsequently closing a second set of blowout preventer rams in the preventer stack thereby trapping an operating pressure between the two sets of blowout preventer rams.

The apparatus of the present invention is particularly advantageous when run with the well testing apparatus operated by well annulus pressure. Thus, once the packer is set the entire testing operation may be controlled by applying pressure to the well annulus. A first set of blowout preventer rams is closed and well annulus pressure is supplied to open the tandem ball valves in the disclosed invention. A second lower set of blowout preventer rams is closed to entrap the ball valve opening pressure between the two sets of closed rams. Additional well annulus pressure may then be applied to operate an annulus pressure responsive tester valve in the lower portion of the well string or an annulus pressure responsive circulation valve when desired.

To quickly release the testing string above the control apparatus it is only necessary to open the lower two sets of blowout preventer rams and to close a higher third set of blowout preventer rams while applying hydraulic pressure to the well annulus. Well annulus pressure trapped below the topmost blowout preventer rams move the quick release section to the open condition allowing the testing string above the control device to be quickly and easily withdrawn from the invention.

The overall well testing environment and the present invention illustrated in the following drawings:

FIG. 1 showing an overall cross-sectional view of a typical well testing installation wherein the apparatus of the present invention may be used;

FIG. 2 showing the present invention displayed in a typical blowout preventer stack of an offshore oil well showing the quick release section above the blowout preventer stack, the fluid passageway section within the blowout preventer stack, the hydraulic fluid reservoir section at the lower end of the blowout preventer stack, and the tandem hydraulic pressure operated ball valves below the preventer stack;

FIGS. 3*a*–3*e* showing an overall cross-sectional view of the apparatus of the present invention;

FIG. 4 showing a cross-sectional view of a typical joint within the invention disclosing details for separating the parallel passageways for activating fluid and the exhaust fluid; and FIG. 5 showing a bottom view of the adapter including means for directing activating fluid into its proper piston chamber and means for directing exhaust fluid from its proper exhaust chamber to the exhaust passageway.

OVERALL WELL TESTING ENVIRONMENT

During the course of drilling an oil well, the borehole is filled with a fluid known as drilling fluid or drilling mud. One of the purposes of this drilling mud is to contain in intersected formations any fluid which may be found there. To contain these formation fluids, the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the test string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus.

The valve at the lower end of the testing string is then opened and the formation fluid, free from the restraining pressure of the drilling fluid, can flow into the interior of the testing string.

The testing program includes periods of formation flow and periods when the formation is closed in. Pressure recordings are taken throughout the program for later analysis to determine the production capability of the formation. If desired, a sample of the formation fluid may be caught in a suitable sample chamber. At the end of the testing program, a circulation valve in the testing string is opened, formation fluid in the testing string is circulated out, the packer is released, and the testing string is withdrawn.

Over the years various methods have been developed to open a tester valve location at the formation depth as described. These methods include string rotation, string reciprocation, and annulus pressure changes. One particularly advantageous tester valve is shown in U.S. Pat. No. 3,856,085 issued Dec. 24, 1974 to Holden et al. This valve operates responsive to pressure changes in the annulus and provides a full opening flow passage through the tester valve apparatus.

The annulus pressure method of opening and closing the tester valve is particularly advantageous in offshore locations where it is desirable to the maximum extent possible, for safety and environmental protection reasons, to keep the blowout preventers closed during the major portion of the testing program.

A typical arrangement for conducting a drill stem test offshore is shown in FIG. 1. Such an arrangement would include a floating work station 1 stationed over a submerged work site 2. The well comprises a well bore 3 typically lined with the casing string 4 extending from the work site 2 to a submerged formation 5. The casing string 4 includes a plurality of perforations at its lower end which provide communication between the formation 5 and the interior of the well bore 6. At the submerged well site is located the well head installation 7 which includes a blowout preventer stack, a typical example of which is shown in FIG. 2. A marine conductor 8 extends from the well head installation to a floating work station 1. The floating work station includes a work deck 9 which supports a derrick 12. The derrick 12 supports a hoisting means 11. A well head closure 13 is provided at the upper end of marine conductor 8. The well head closure 13 allows for lowering into the marine conductor and into the well bore 3 a formation testing string 10 which is raised and lowered in the well by hoisting means 11.

A supply conduit 14 is provided which extends from a hydraulic pump 15 on the deck 9 of the floating station 1 and extends to the well head installation 7 at a point below the blowout preventers to allow the pressurizing of the well annulus 16 surrounding the test string 10.

A testing string includes an upper conduit string portion 17 extending from the work site 1 to the well head installation 7. A pressure operated conduit string test tree of the present invention 18 is located at the end of the upper conduit string 17 and is landed in the well head installation 7 to thus support the lower portion of the formation testing string.

The lower portion of the formation testing string extends from the test tree of the present invention 18 to the formation 5. A packer mechanism 27 isolates the formation 5 from fluids in the well annulus 16. A perforated tail piece 28 is provided at the lower end of the testing string 10 to allow fluid communication between the formation 5 and the interior of the tubular formation testing string 10.

The lower portion of the formation testing string 10 further includes intermediate conduit portion 19 and torque transmitting pressure and volume balancing slip joint means 20. Such a slip joint means is disclosed in U.S. Pat. No. 3,354,950 to Hyde issued Nov. 28, 1967.

An intermediate conduit portion 21 is provided for imparting packer setting weight to the packer mechanism 27 at the lower end of the string.

A circulation valve 22 such as that disclosed in U.S. Pat. No. 3,850,250 issued to Holden et al Nov. 26, 1974 may be used near the end of the testing string 10 above the tester valve 25. If it is desired to trap a sample of formation fluid flowing in the testing string 10 at the time tester valve 25 is closed, a combination sample valve and circulation valve may be installed at 22 such as either of those disclosed in Ser. No. 769,123 to Jessup or Ser. No. 769,129 to Barrington, both filed Feb. 16, 1977.

A pressure recording device 26 is located below the tester valve 25. The pressure recording device 26 is preferably one which provides a full opening passageway through the center of the pressure recorder to provide a full opening passageway through the entire length of the formation string 10 when all testing valves are in the open position.

It may be desirable to add additional formation testing apparatus to the testing string 10. For instance, where it is feared that the testing string 10 may become stuck in the borehole 3 it is desirable to add a jar mechanism between the pressure recorder 26 and the packer assembly 27. The jar mechanism is used to impart blows to the testing string to assist in jarring a struck testing string loose from the borehole in the event that the testing string should become struck. Additionally, it may be desirable to add a safety joint between the jar and the packer mechanism 27. Such a safety joint would allow for the testing string 10 to be disconnected from the packer assembly 27 in the event that the jarring mechanism was unable to free a stuck formation testing string.

The location of the pressure recording device may be varied as desired. For instance, the pressure recorder may be located below the perforated tail piece 28 in a suitable pressure recorder anchor shoe running case. In addition, a second pressure recorder may be run immediately above the tester valve 25 to provide further data to assist in evaluating the well.

DESCRIPTION OF THE PREFERRED EMBODIMENT

Figure 2:
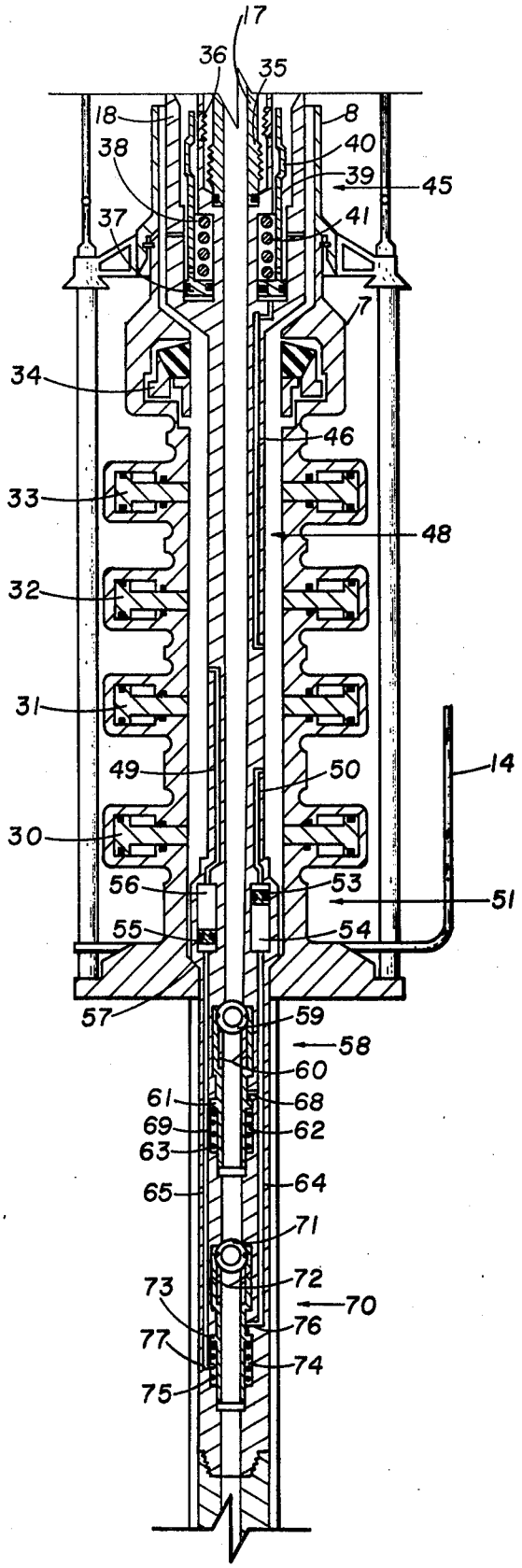

FIG. 2 shows in more detail well head installation 7 with the pressure operated test tree 18 disclosed herein in place. Shown is a typical well head installation having a stack which typically includes a plurality of blowout preventer rams 30-33 designed to form a fluid tight seal around the pipe running through the blowout preventer stack. This arrangement is designed to prevent pressure from passing the rams from their lower side to their upper side between the centrally located pipe and the closed rams. These blowout preventer stacks may include one or more blind rams which are designed to form a fluid tight seal between the faces of the ram when a pipe is not present in the center of the blowout preventer stack.

In FIG. 2 it may be assumed for illustration purposes that the bottom three ram sets 30, 31 and 32 are pipe type rams. Ram set 33 is not discussed in conjunction with the present invention configuration and may be considered either a pipe type ram or a blind type ram. An annular blowout preventer 34 effects a fluid tight seal around the annulus between the apparatus and the blowout preventer stack when actuated.

The apparatus of the present invention may be used with a variety of blowout preventer stacks provided the apparatus is arranged prior to the setting of the apparatus 18 in the well head installation 7 such that the pressure passageways of the apparatus are aligned properly with proper sets of pipe type blowout preventer rams.

As shown in FIG. 2, the apparatus of the present invention includes a quick release section 45, a pressure passageway section 48, a hydraulic reservoir section 51, an upper ball valve section 58, and a lower ball valve section 70.

The quick release section 45 is at the top of the test tree 18 and includes a mechanism for quickly releasing the upper conduit string 17 of the testing string. Such a quick release might be necessary for an emergency situation such as the arrival of a storm or other situation which requires that the upper conduit string 17 be removed quickly from the well bore 3 with the pressure operated test tree 18 remaining in the blowout preventer stack in the closed position.

FIG. 2 further illustrates helical teeth 35 which appear at the end of the conduit string 17. A plurality of latch blocks 36 are positioned in the upper end of the test tree 18, which latch blocks contain helical teeth for cooperation with the helical teeth 35 at the end of upper conduit string 17. The helical teeth in latch block 36, and the teeth 35 at the end of string 17 are designed such that the string 17 may be removed by unscrewing the teeth. In this event, test tree 18 is prevented from rotation by the pressure of closed pipe rams, which rams also close the well annulus through the blowout preventer stack, or by the weight of the testing string 10 below the test tree 18. The lower portion of the testing string will also be prevented from rotation if packer mechanism 27 is set.

The quick release mechanism 45 may also be operated hydraulically to allow latch blocks 36 to move radially outwardly out of the way of helical teeth 35 to allow upper conduit string 17 to be removed from the test tree 18. Quick release section 45 includes piston 37 which may move upwardly and downwardly in quick release chamber 38. Connected to piston 37 and forming one wall of chamber 38 is release operating mandrel assembly 39. Mandrel assembly 39 includes an enlarged portion 40 which, when aligned behind latch blocks 17, allows latch blocks 17 to move outwardly. Helical teeth 35 are slanted for pushing the teeth on latch block 37 radially outwardly thus urging blocks 17 outwardly into area 40.

A spring 41 is provided in chamber 38 to hold piston 37 in the downmost position, thus holding latch blocks 36 in the inwardmost position to prevent the withdrawal of the end of upper conduit string 17.

A quick release pressure passageway 46 is provided in the pressure passageway section 48, and leads from the chamber 38 to a position below the third pipe ram set 32 in the blowout preventer stack.

It can thus be seen to operate the quick release mechanism hydraulically it is only necessary to close the third pipe ram set 32 in the blowout preventer stack and to pressurize the well annulus 16 below the closed pipe ram set 32 by means of the supply conduit 14. This increased pressure will be communicated to the bottom end of piston 37 by means of pressure passageway 46. This increased pressure will move piston 37 upwardly and thus move the enlarged portion 40 of the release mandrel assembly 39 upwardly until enlarged portion 40 is behind the latch blocks 36. Latch blocks 36 may then be moved radially outwardly to release helical teeth 35 in the lower end of conduit string 17 as conduit portion 17 is raised from the surface.

Pressure passageway section 48 also includes exhaust pressure passageway 49 and ball control pressure passageway 50. Ball control pressure passageway 50 leads from between the first and second pipe ram sets 30 and 31 of the blowout preventer stack to an activating cylinder 54 in the hydraulic reservoir section 51. Exhaust pressure passageway 49 extends from between the second and third pipe ram sets 31 and 32 of the blowout preventer stack to an exhaust cylinder 56 in the hydraulic reservoir section 51. Activating cylinder 54 is divided by an activating piston 53 such that increases in fluid pressure below the second ram set 31 will move activating piston 53 downwardly. Exhaust cylinder 56 is divided by an exhaust piston 55 such that increases in pressure below the exhaust piston 55 will move the exhaust piston 55 upwardly displacing fluid in the upper portion of cylinder 56 through exhaust passageway 49 to the area between the second and third blowout preventer ram sets 31 and 32.

Shown also in FIG. 2 is hand-off point 57 for the testing string 10 which threadably attaches to the lower end of the test tree apparatus 18. This hang-off point may vary from well installation to well installation and an adapter may be provided to provide an appropriate spacing between hang-off point 57 and the actual hang-off point in the well installation to position the apparatus as shown in FIG. 2.

A hydraulic fluid passageway 64 leads from the activating cylinder 54 downwardly to the lower portion of the test tree 18. Likewise, an exhaust hydraulic fluid passageway 65 is provided in the wall of the apparatus and leads from the exhaust cylinder 56 in hydraulic fluid reservoir section 51 downwardly past the upper ball valve section 58 to the lower ball valve section 70.

An activating port 68 is provided in the walls of the apparatus and leads from the activating fluid passageway 64 to the top of a piston 61 in an upper chamber 62. An exhaust port 69 is provided in the walls of the apparatus between the lower portion of the cylinder 62 to the exhaust passageway 65 in the walls of the apparatus.

Immediately below the hydraulic fluid reservoir section 51 is upper ball valve section 58 which includes a rotatable ball 59 shown in the closed position, and an upper ball activating mechanism 60. The upper ball activating mechanism 60 includes the operating piston 61, a portion of which forms one end of an upper chamber 62. Included in upper chamber 62 is a ball closing spring 63 which urges piston 61 and ball activating mechanism 60 upwardly toward the closed position. This spring has enough force to move the ball 59 to the closed position when hydraulic activating pressure is not present.

The lower section of the apparatus 18 includes lower ball valve section 70. Section 70 includes a lower ball 71 shown in the closed position. Lower ball 71 is also activated by an activating mechanism 72 which includes a piston 73 in a lower cylinder 74.

In the lower cylinder 74 below the piston 73 is a lower ball closing spring 75. This spring also has sufficient force to push upwardly on piston 73 and to act on ball activating mechanism 72 to rotate ball 71 toward the closed position when hydraulic pressure is not present in the activating hydraulic pressure passageway 64.

An activating port 76 is provided in the walls of the apparatus leading from the activating pressure passageway 64 to the lower cylinder 74 at a point above the piston 73. An exhaust port 77 is provided in the walls of the apparatus 18 leading from the lower chamber 74 to the exhaust passageway 65.

To operate the ball valve sections 58 and 70 of the present apparatus the second pipe ram set 31 of the blowout preventer stack is closed and a hydraulic pressure is added by means of supply line 14 to that portion of the well annulus below the closed ram set 31. This increased hydraulic pressure acts through passageway 50 to the top side of floating piston 53 in cylinder 54. As floating piston 53 is pushed downwardly by this increased pressure, hydraulic fluid in the lower portion of cylinder 54 is displaced into pressure passageway 64. This hydraulic fluid is passed through ports 68 and 76 to the top sides of pistons 61 and 73 of the ball activating mechanisms 60 and 72 respectively. As the pistons 61 and 73 are moved downwardly under the influence of the hydraulic fluid in passageway 64, balls 59 and 71 are rotated to the open position.

Hydraulic fluid which exists in the lower portions of cylinders 62 and 74 is exhausted through exhaust ports 77 and 69 respectively into exahust passageway 65. This fluid is in turn displaced into the lower portion of cylinder 56 and moves floating piston 55 upwardly. The well annulus fluid in the upper portion of cylinder 56 is exhausted through exhaust passageway 49 to the area above the closed second ram set 31. Thus to rotate the balls 59 and 71 to the open position it is necessary to close the ram sets 31 and pressure the well annulus through supply conduit 14. This rotation of the balls displaces well annulus fluid out of cylinder 56 and into the well annulus via passageway 49 to an area above the closed ram set 31. It is thus necessary during this operation to open ram sets 32 and 33 and annular type blowout preventer 34 such that this displaced well fluid may flow into the well annulus above the blowout preventer stack.

As can be seen in FIG. 2, rotating balls 59 and 71 to the open position leaves a fully open bore through the entire length of the test tree apparatus 18. Once the ball valves 59 and 71 are in the fully open position the lowest ram set 30 may be closed to trap the hydraulic pressure needed to maintain these balls in the open position. Additional pressure may then be applied to the well annulus by supply conduit 14 to operate the tester valve 25 in the lower portion of the testing string 10.

The desired pressure to operate the ball valve sections 58 and 70 of the present apparatus is in the range of approximately 600 PSI. This 600 PSI will open the valves 58 and 70 of the present apparatus, but will not operate the preferred tester valve 25. Additional increases in annulus pressure by use of supply conduit 14 will subsequently operate tester valve 25 and the preferred circulation valve 22 previously described.

To close an annulus pressure responsive type of tester valve 25, hydraulic pressure is exhausted through supply conduit 14 to return the pressure in the well annulus 16 to its normal level.

In the event that pipe ram set 30 will not hold a higher pressure above the pipe ram than below the pipe ram, this lower pipe ram set 30 may be reopened and annulus pressure may be again supplied by supply conduit 14 to the 600 PSI level. Once 600 PSI has again been reached in the annulus, the lowest pipe ram set 30 may be again closed and the annulus pressure may be maintained at this level to keep the tester valve 25 in the closed position and the tandem ball valves of the test tree 18 in the open position.

To quickly close valves 58 and 70 of the present invention and operate the quick release mechanism, it is only necessary to open pipe ram sets 30 and 31 and simultaneously close pipe ram set 32. The equalization of pressure below ram set 32 will close the ball valve sections 58 and 70. Sufficient hydraulic pressure is then added below closed pipe ram set 32 by supply conduit 14 to operate quick release secton 45 as described. All of the pipe ram sets may then be closed, or selected ones of the pipe ram sets in addition to set 32 may be closed to prevent a well blowout through the well annulus.

Referring now to FIGS. 3*a*–3*e* a complete view of the apparatus in cross-section is shown. Starting with the top of the tool, a cone shaped end section 80 of the outer housing assembly is shown. The inner wall of this end section 80 is cone shaped to guide the lower end of upper testing string 17 to enter into the assembly when the testing string is lowered into the subsea conduit 8 to be stabbed into the assembly 18.

The outer housing assembly with its incorporated flow passageways will next be described.

Threadably connected to the end section 80 is a quick release housing section 81 having an exhaust port 82. Threadably connected below the quick release housing section 81 is the lower end adapter 83 for joining quick release section 45 to pressure passageway 48.

A passageway 84 is provided in the lower end adapter 83. A lateral port 85 is provided through the lower end of housing section 83 for providing fluid communication between passageway 84 and a circumferential groove 86 which is provided at the lower end of adapter 83. Threadably connected into the lower end of adapter 83 is conductor pipe 87 which provides the outer housing of pressure passageway section 48.

A lateral port 88 communicating with groove 86 and passageway 46 is provided through the upper end of conductor pipe 87. A plug means 89 is provided in the exterior end of lateral port 85 to provide a fluid tight seal between the area exterior of the apparatus 18 and the fluid passageway 84. This seal may be a weld or other suitable material for providing the fluid tight pressure seal described.

Figure 3A:
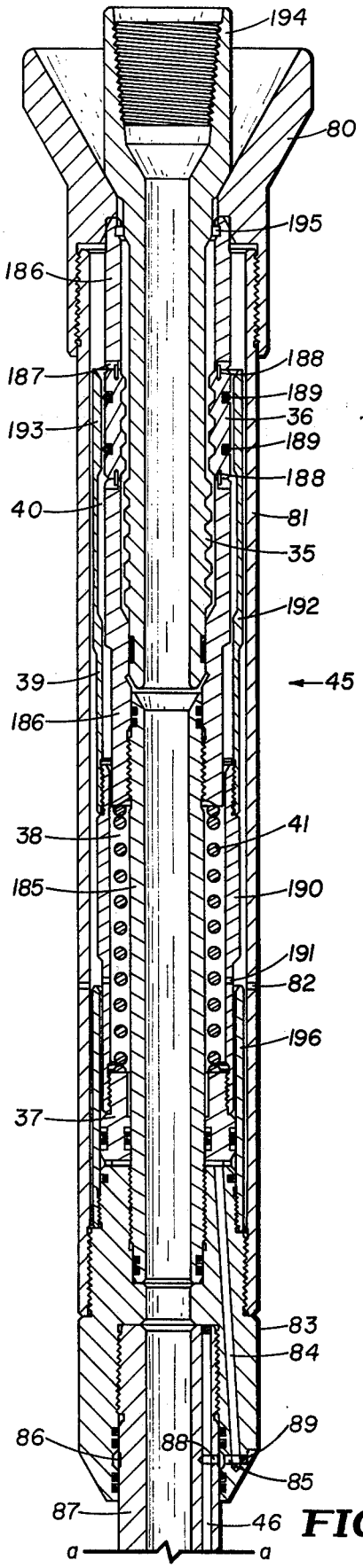
Figure 3B:
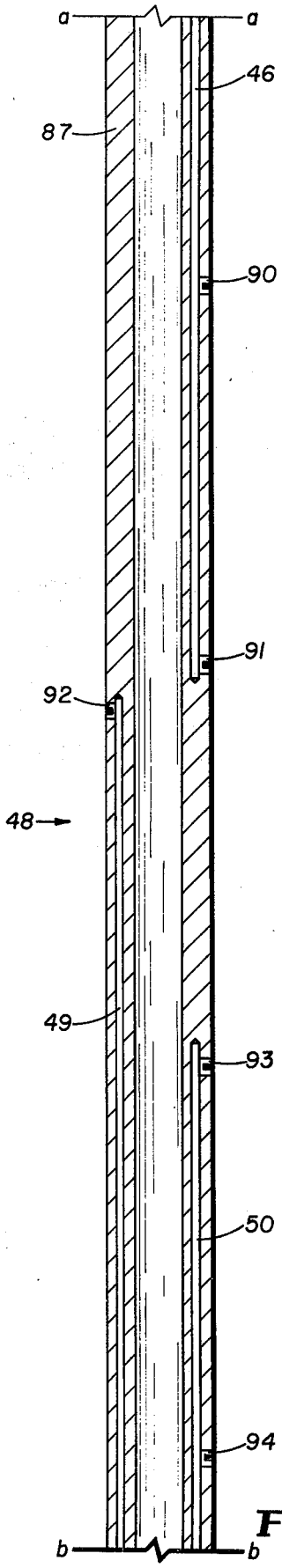
Figure 3C:
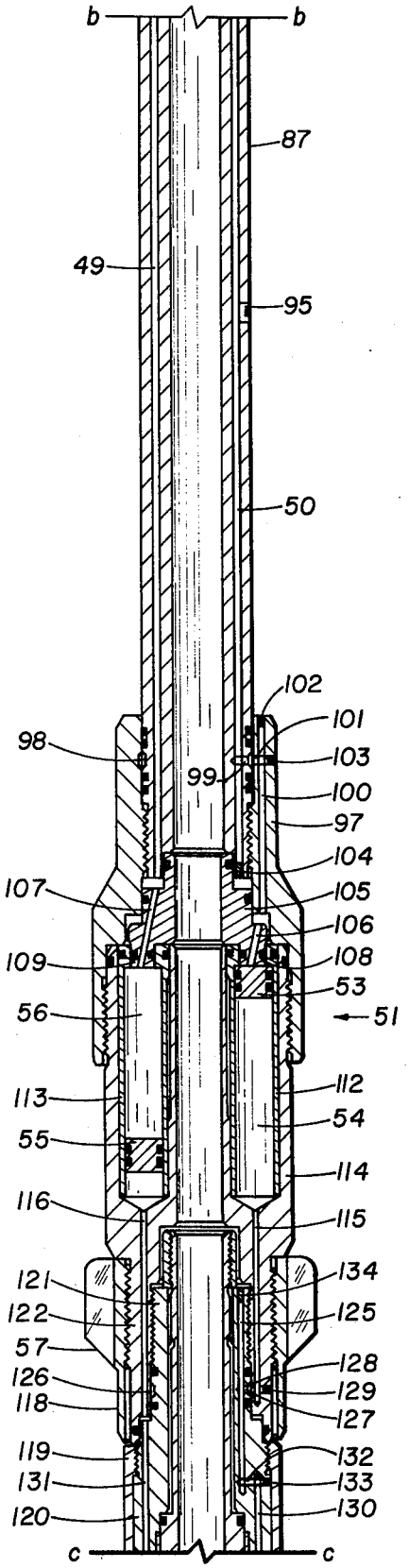

FIG. 3*b* and the upper half of FIG. 3*c* shows a view of pressure passageway section 48 having quick release pressure passageway 46, exhaust pressure passageway 49 and ball control pressure passageway 50 explained in conjunction with FIG. 2.

Threaded plugs 90 and 91 are provided in the walls of conduit pipe 87 for allowing fluid pressure in the area external of the test tree 19 to enter into quick release pressure passageway 46. These threaded plugs also allow for the changing of spacing of communication ports between the passageway 46 and an area above the desired ram set of the particular stack used.

Threaded plug 92 may be removed to provide a port for fluid pressure communication from the exterior of the apparatus 18 to the exhaust pressure passageway 49. The plugs 93-95 are provided for changing the spacing of the open communication port from the area exterior of the apparatus 18 to the ball operating pressure passageway 50.

Shown in FIG. 3*c* is a housing adapter 97 for joining the conductor pipe 87 of the pressure passageway section 48 to the hydraulic fluid reservoir section 51. A circumferential groove 98 is provided in the lower end of conductor pipe 87. A lateral port 99 is provided in the lower end of conductor pipe 87 for lateral fluid communication between passageway 50 and groove 98.

A passageway 100 is provided in adapter 97. A lateral port 101 is provided in the adapter 97 for fluid communication between groove 98 and passageway 100. A sealing means 102 is provided to seal the exterior end of fluid passageway 100 in adapter 97. Likewise, sealing means 103 is provided to seal the exterior end of lateral port 101 through adapter section 97.

Sealing means 104 is provided at the end of passageway 50 to provide a fluid tight seal to the end of passageway 50 to prevent communication of fluid pressure in ball activating pressure passageway 50 with the fluid pressure in exhaust passageway 49.

An adapter 105 is provided for joining activating ball operating passageway 50 and exhaust passageway 49 with activating cylinder 54 and exhaust cylinder 56 respectively. Adapter 105 includes ball operating pressure passageway 106 and exhaust pressure passageway 107 as shown. At the lower end of adapter 105 is ball operating pressure passageway extension 108 and exhaust pressure passageway extension 109. It should be noted at this point that extensions 108 and 109 have different diameters to allow the bottom end of extension 105 to be entered into cylinders 54 and 56 only in the proper alignment. This design prevents adapter 105 from being installed incorrectly and thus ensures that the ball activating pressure passageway is correctly installed into the ball activating cylinder 54 and that the exhaust pressure passageway 49 is correctly installed into the exhaust cylinder 56.

A cylinder liner 112 is provided for cylinder 54 and a cylinder liner 113 is provided for cylinder 56. Liner 112 has the proper diameter opening at the top to provide for a sealing fit with extension 108 and adapter 105. Likewise, liner 113 has the proper opening at its top to provide for a sealing fit with extension 109 of adapter 105. As discussed in conjunction with FIG. 2, a floating piston 53 appears inside of cylinder 54 and a floating piston 55 appears inside of cylinder 56.

At the upper end of piston 53 operating fluid pressure is provided by the hydraulic pressure of the well fluid in the annulus exterior of the apparatus 18. Hydraulic fluid is located in the cylinders 54 and 56 below floating pistons 53 and 55 respectively for providing operating fluid to the ball mechanisms which appear below the hydraulic reservoir section 51.

Continuing with the discussion of the outer housing assembly and its included flow passageways, activating fluid passageway 115 is provided in the lower end of housing section 114. This fluid passageway 115 communicates with the lower end of activating hydraulic fluid reservoir 54. Likewise, an exhaust fluid passageway 116 is provided in the lower end of housing section 114, which passageway communicates with the lower end of exhaust cylinder 56.

Threadably connected to the lower end of housing section 114 is a testing string hanger means 118 including the hang-off surface 57 as discussed in FIg. 2. Below hanger means 118 is a hanger retaining sleeve 119 threadably connected to the housing below the hanger means 118.

An upper ball valve housing 120 is threadably connected to the lower end of section 114. Upper valve housing 120 includes an extension 121 which is threadably connected into an extension 112 of the lower end of housing 114. An activating fluid passageway 125 is provided in extension 121.

A circumferential groove 126 is provided in the extension 121 which has a lateral port 127 communicating between groove 126 and passageway 125. Lateral port 128 is provided in the lower extension 122 which port communicates with the groove 126 and passageway 115. A sealing means 129 is provided for sealing the exterior end of port 128.

An activating fluid passageway 130 is provided in the upper valve housing section 120. An exhaust fluid passageway 131 is provided in housing section 120 which communicates with exhaust passageway 116. A lateral port 132 is provided in the upper end of housing section 120 for providing fluid communication between the passageway 125 in extension 121 and the passageway 130 in housing section 120.

A sealing means 133 is provided for a fluid tight seal at the external end of lateral port 132. Likewise, a sealing means 134 is provided at the upper end of passageway 125 for providing a fluid tight seal at the end of passageway 125.

Threadably attached to the lower end of housing section 120 is an upper chamber housing section 135. The upper end of housing section 135 includes an upper extension 136. Slidably located within the extension 136 of housing section 135 is an upper portion 139 of piston mandrel assembly 60 for operating the upper ball 59.

An activating fluid passageway 137 appears in the extension 136. Circumferential groove 138 is provided around the upper end of extension 136. The activating fluid port 68 to the area above the piston 61 is formed by a lateral port for providing communication with the groove 138 completely through the upper end of extension 31 to the area between the piston mandrel portion 139 and extension 136.

A lateral port 141 for providing fluid communication between passageway 130 and groove 138 is provided in the lower end of housing section 120. A sealing means 142 is provided for sealing the exterior end of port 141. Also, a sealing means 140 is provided for sealing the end of activating fluid passageway 137.

An activating fluid passageway 144 is also provided in cylinder housing 135. A lateral port 145 is provided for giving fluid communication between passageway 137 in extension 136 and passageway 144 in housing section 135. Sealing means 146 is provided for sealing the exterior end of lateral port 145.

An exhaust passageway 147 is provided in housing section 135 and communicates directly with the passageway 131 in housing section 120.

Exhaust port 69 is provided by a lateral port in the wall of housing section 135 and provides fluid communication between the cylinder 62 and the exhaust passageway 147 in the wall of housing section 135. A sealing means 148 is provided in the exterior end of the lateral port forming exhaust port 69.

Looking to the lower end of housing section 135 immediately below the cylinder 62 is a housing adapter 149 which threadably joins the upper ball valve section 58 and the lower ball valve section 70. The housing adapter 149 includes an upper extension portion 150 and an activating fluid passageway 151 therein.

A circumferential groove 152 appears near the lower end of extension 150. A lateral port 153 extends through the walls of extension 150 to provide fluid communication between lateral groove 152 and activating fluid passageway 151 in extension 150. A lateral port 154 through the walls of housing 135 provides fluid communication between passageway 144 and groove 152. A sealing means 155 gives a fluid tight seal at the exterior end of port 154.

A sealing means 156 provides a fluid tight seal at the end of passageway 151 in extension 150.

An activating fluid passageway 157 is provided in housing adapter 149. A lateral port 158 is provided for fluid communication between the passageway 151 in extension 150 and the fluid passageway 157 in the adapter 149. A sealing means 159 is provided in the exterior end of lateral port 158.

An exhaust passageway 160 passes through the housing adapter section 149 and communicates directly with the exhaust fluid passageway 147 in chamber housing section 135.

Figure 3D:
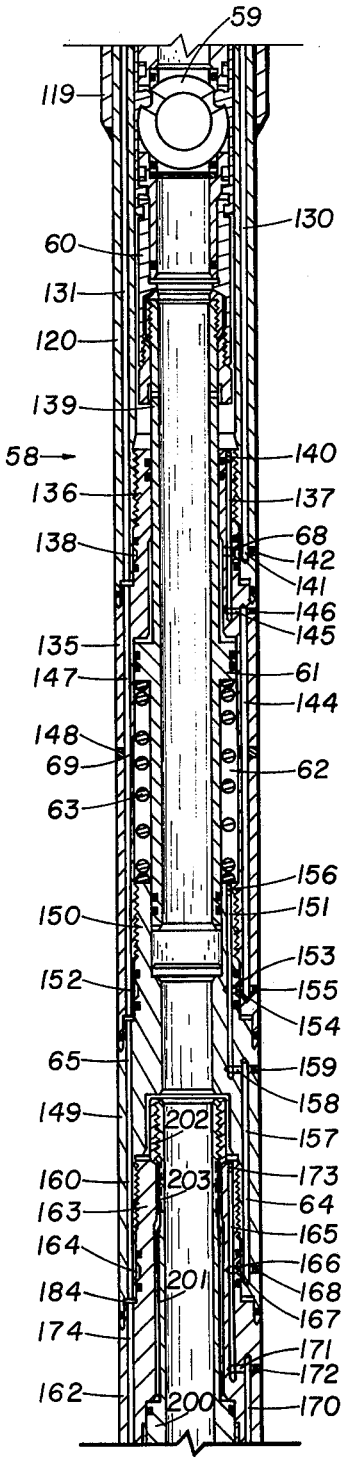
Figure 3E:
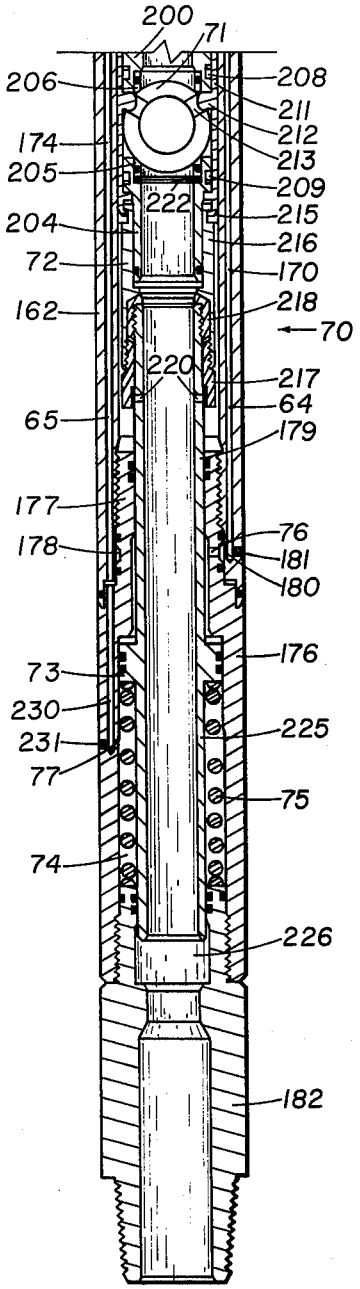

Shown in the lower portion of FIG. 3*d* and the upper portion of FIG. 3*e* is a lower ball housing section 162. This housing section 162 includes an upper extension 163 threadably attached within the lower end of adapter housing section 149.

Extension 163 includes a circumferential groove 164 as shown in FIG. 3*d*. An activating fluid passageway 165 is provided in extension 163.

A lateral port 166 is provided in the wall of extension 163 to provide fluid communication between groove 164 and passageway 165. A lateral port 167 in the lower end of adapter housing section 149 provides fluid communication between fluid passageway 157 and groove 164. A sealing means 168 is provided at the exterior end of port 167.

An activating fluid passageway 170 is provided in the wall of housing section 162. A lateral port 171 is provided in the wall of housing section 162 to provide fluid communication between the passageway 165 in extension 163 and the fluid passageway 170 in the walls of housing section 162. A sealing means 172 is provided at the exterior end of port 171 to provide a fluid tight seal.

Additionally, sealing means 173 is provided at the end of passageway 165 in the extension 163.

An exhaust passageway 174 in the walls of housing section 162 communicate directly with the exhaust passageway 160 in the adapter housing section 149.

In FIG. 3*e* may be seen a lower chamber housing section 176 which is threadably attached into the lower end of ball housing section 162. The lower chamber housing 176 includes at its upper end an extension 177.

A circumferential groove 178 is provided in extension 177. As provided in the upper ball valve section 58, an upper portion 179 of ball operating piston mandrel assembly 72 is provided in the inner bore of the outer housing assembly. A ball actuating fluid port 76 is provided by a lateral port which extends completely through the wall of extension 177 to the area between extension 177 and the piston mandrel portion 179. This port provides for fluid pressure communication from activating fluid passageway 170 to the area between lower chamber housing 176 and the piston mandrel portion 179, then to the upper side of the ball operating piston 73.

A lateral port 180 is provided through the wall of the lower end of ball housing section 162 to provide fluid communication between the fluid passage 170 in housing section 162 and circumferential groove 178. A sealing means 181 is provided in the exterior end of the lateral port 180 to provide a fluid tight seal.

An exhaust port 77 is provided by a lateral port through the walls of chamber housing section 176 for providing fluid communication between chamber 74 and exhaust passageway 230 in housing section 176. The exterior end of the lateral port forming exhaust port 77 is sealed by sealing means 231. Exhaust passageway 230 communicates directly with the exhaust passageway 174 in housing section 162.

Figure 1:
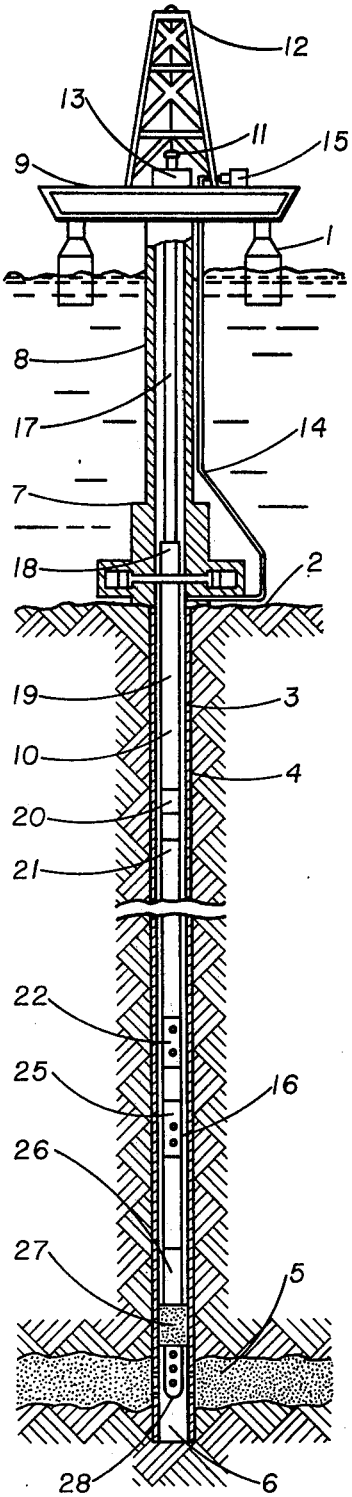

A bottom adapter 182 is provided in the lower end of the outer housing assembly to join the apparatus of the invention 18 with the top of the conduit string 19 of the testing string 10 shown in FIG. 1.

Figure 4:
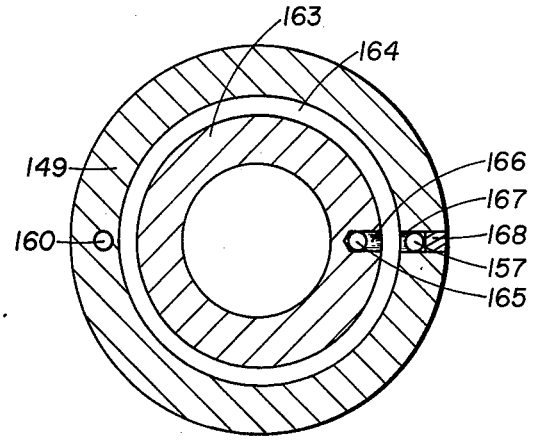

The construction of the fluid actuating passages and the exhaust passageway may be further understood by looking at FIG. 4. FIG. 4 is a detailed diagram of a typical joint such as the joint between the upper extension 163 of the housing section 162 and the lower end of adapter housing section 149. FIG. 4 is a drawing of the bottom end of the mentioned housing sections looking upwardly at a horizontal plane passing through the center of the sealing means 168 and the circumferential groove 164.

The upper extension 163 of housing section 162 may be seen with the fluid passageway 165. The lower end of adapter housing section 149 may be seen with the actuating fluid passageway 157 on the right side and the exhaust fluid passageway 160 on the left side. The circumferential groove 164 in extension 163 is also shown and appears between extension 163 and the walls of housing adapter 149. It can be seen that a lateral port 166 is provided between the circumferential groove 164 and the inner fluid passageway 165. Likewise, the lateral port 167 may be seen which provides fluid communication between fluid passageway 157 and the circumferential groove 164. Sealing means 168 is also shown which seals the exterior end of lateral port 167.

All activating fluid passageways for passageway 64 have been shown on the right side of FIGS. 3*a*—3*e*, and all exhaust fluid passageways for passageway 65 have been shown on the left side to make the drawings more understandable. But, it can be seen from FIG. 4 that the exact alignment of ports 166 and 167 is unnecessary. In other words, actuating fluid flowing in passageway 157 may be transmitted through lateral port 167 into circumferential groove 164. The fluid then is free to flow around extension 163 in groove 164 until it reaches lateral port 166. The fluid then flows through lateral port 166 and into fluid passageway 165.

It may also be seen in FIG. 3*d* that exhaust fluid flowing in fluid passageway 160 in adapter housing 149 may communicate with fluid with the passageway 174 in housing section 162. This is true regardless of the alignment of fluid passageways 160 and 174. This is true because exhaust fluid flowing in passageway 174 may flow into the void space 184 shown in FIG. 3*d* between the lower end of housing adapter 149 and the step where extension 163 joins housing section 162.

Fluid communication between void space 184 and circumferential groove 164 is prevented by appropriate seals on either side of circumferential groove 164 as shown in FIG. 3*d*.

The other joints described in connection with FIGS. 3*a*—3*e* may likewise be constructed to provide two separate fluid passageways, one for ball activating fluid and one for exhaust fluid.

Figure 5:
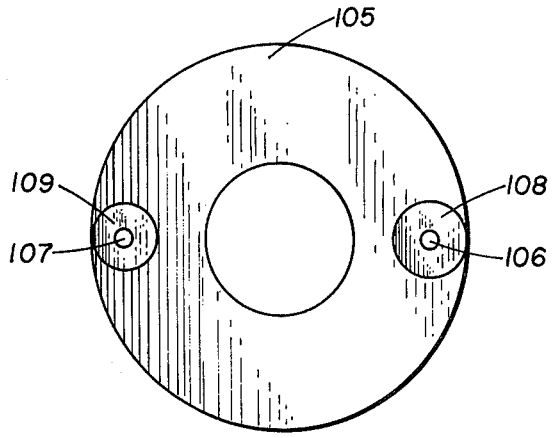

The bottom of adapter section 105 is illustrated in FIG. 5 showing the circular extensions 106 nd 109. FIG. 5 is the bottom view looking upwardly at adapter 105. Also shown in FIG. 5 at the center of extensions 106 and 109, are fluid passageways 108 and 107.

It can be seen in FIG. 5 that the diameter of extension 106 differs from the diameter of extension 109 so that the extensions 106 and 109 and adapter 105 may be fitted into the appropriate openings in cylinder linings 112 and 113, respectively to prevent incorrect assembly of the apparatus.

Returning now to the quick release section 45 of FIG. 3*a*, an inner mandrel 185 may be seen which forms the inner wall of chamber 38 and which is threadably attached to adapter 83. Above inner mandrel 185 is threadably attached a latch mandrel 186 through which are a plurality of windows 187. Pins 188 in latch blocks 36 prevent the latch blocks 36 from falling through the windows 188 in the latch mandrel 186. Coil springs 189 are around the periphery of mandrel 186 in appropriate slots in mandrel 186 and latch blocks 36, and urge the latch blocks 36 inwardly.

The release mandrel assembly 39 is formed by an outer mandrel 190 forming the outer walls of chamber 38. The outer mandrel 190 includes exhaust ports 191 for exhausting fluid from chamber 38 as piston 37 moves upwardly. It may be seen that fluid exhausted from chamber 38 may pass through ports 191 and ports 82 to the annulus exterior of the apparatus 18.

A latch release mandrel 192 is threadably attached to the top of outer mandrel 190. This latch release mandrel 192 includes the cutout portions 40 previously referred to which release blocks 36 when moved sufficiently upwardly. The upper end 193 of release mandrel 192 is positioned in the normal position behind latch blocks 36 to prevent latch blocks 36 from moving outwardly.

A stinger section 194 is attached to the lower end of conduit section 17 for insertion into the apparatus 18. This stinger section 194 includes teeth 35 at its lower end previously referred to in connection with FIG. 2.

At 195 are cooperating keys and slots between the stinger section 194 and the upper portion of latch mandrel 186. These keys and slots are arranged to properly position the stinger section circumferentially during the last increment of downward travel of the stinger section 194 into the quick release section 45. This positioning is such that when the stinger section 194 is lifted upwardly, the top teeth of teeth 35 of the stinger section 194 will meet the bottom teeth of the latch blocks 36 evenly to prevent all of the upward force from being applied to a single tooth in a latch block 36 and a portion of the teeth 35 in the stinger section 194. This alignment also properly aligns the teeth 35 in the stinger section 194 and the teeth in latch blocks 36 such that if desired the stinger section 194 may be rotated to screw the stinger section 194 out of the latch blocks 36.

At the end of chamber 38 is a sleeve 196 threadably attached to adapter 83 for forming the bottom outside wall of chamber 38.

Turning now to the bottom portion of FIG. 3*d* and the top portion of FIG. 3*e*, the ball retaining and operating mechanism will be discussed. Since the ball retaining and operating mechanism for upper ball valve section 58 and the lower ball valve section 70 are identical, only the ball retaining and operating mechanism of lower ball valve section 70 will be discussed. It will be understood that an identical apparatus is present for the upper ball valve section 58.

The ball retaining mechanism includes upper ball retaining sleeve 200 which has an upper extension 201. An end sleeve 202 is provided for retaining the ball retaining sleeve 200 in a fixed position. This end sleeve 202 is trapped between the upper end of upper extension 163 of housing section 162 and the lower end of adapter section 149. Cooperating splines at 203 are provided in the upper extension 163 of the housing section 162 and the upper extension 201 of the ball retaining sleeve 200 to prevent rotation between the housing section 162 and the ball retaining sleeve 200.

A lower ball retaining sleeve 204 is positioned below the ball 71. A lower ball seat 205 is located in a groove in the lower ball retaining sleeve 204, and an upper ball seat 206 is located in a groove in the upper ball retaining sleeve 200.

An upper C-clamp groove 208 is provided in upper sleeve 200 and a lower C-clamp groove 209 is provided in lower ball retaining sleeve 204. C-clamps (not shown) may extend intermediate pin arms 211 from upper C-clamp groove 208 to lower C-clamp groove 209. This configuration is well understood by those skilled in the art and is further disclosed in U.S. Pat. No. 3,856,085 issued Dec. 24, 1974 to Holden et al.

Intermediate the C-clamps are pin arms 211 extending around the outer periphery of ball 71 and from a position above the ball to a position below the ball as shown in FIG. 3e. Pins 212 on pin arms 211 are fitted into holes 213 in ball 71 for rotating the ball 71 between the closed and open positions.

The lower end of pin arms 211 includes end 215 having a C-clamp cross-section. A connecting mandrel 216 includes a groove at its end for cooperation with ends 215 and arranged for both pulling the rotatable ball 71 to the open position and pushing the rotatable ball 71 to the closed position. An end sleeve 217 is connected to the connecting mandrel 216.

A cooperating end sleeve 218 is connected to the upper end of the piston mandrel portion 179. These cooperating end sleeves 217 and 218 are also designed to both pull the connecting mandrel 216 and to push the connecting mandrel 216. Holes 220 are provided in piston mandrel portion 129 to prevent a hydraulic lock as the connected pin arms, mandrels, end sleeves and piston portion are moving upwardly or downwardly.

A belleville spring 222 is provided between the lower ball retaining sleeve 204 and the lower ball seat 205 for urging the seats 205 and 206 and the ball 71 together to form a fluid tight seal.

A lower portion 225 of the operating piston mandrel assembly forms the inner wall of lower chamber 74. Beneath the lower end of portion 225 of the operating piston mandrel assembly is an operating space 226. This space is provided to allow the piston mandrel portion 225 to move downwardly to open the closed ball 71.

It can thus be seen that the invention disclosed provides a hydraulically operated subsea test tree having a pair of ball valves which may be hydraulically moved from the closed position to the open position by pressuring the well annulus below a set of closed blowout preventer rams. Hydraulic pressure below the closed preventer rams act to pressurize independent ball operating pistonsto move the pistons and associated ball operating mechanisms in one direction to rotate the balls independently to the open position.

As the pistons move downwardly, the fluid below the pistons is exhausted by the downward motion of the pistons and transferred to an area above the closed blowout preventer rams. When it is desired to close the ball valves of the present invention it is only necessary to remove the elevated pressure in the well annulus. This may be done by releasing the pressure through a supply conduit or by opening the closed blowout preventer rams to equalize pressure on either side of the rams. Such a release of fluid pressure in the well annulus allows compressed springs on the other sides of the operating pistons to move the operating pistons in a second direction, thus closing the balls.

The balls are operated independently of one another such that one ball may be rotated to the closed position by its associated spring if the other ball for some reason should be blocked such that it may not rotate to the closed position.

A quick release section is also disclosed which may be operated by applying fluid pressure below a set of closed blowout preventer rams or which may be released by unscrewing threads in the lower portion of a stinger attached to a testing string leading to the surface from threads provided in the subsea test tree apparatus.

The foregoing disclosure is intended to be illustrative only and is not intended to cover all embodiments that may occur to one skilled in the art to accomplish the foregoing objectives. Other embodiments which work equally well and are equivalent to the embodiments shown may be imagined by one skilled in the art. The attached claims are intended to cover such equivalent embodiments of the invention which may occur to one skilled in the art.

What is claimed is:

1. A method of controlling a valve in the vicinity of a blowout preventer stack located on a sea floor over an oil well comprising:

closing a set of rams in the blowout preventer stack for providing a fluid pressure seal from one side of said rams to the other side of said rams;

applying hydraulic pressure to one side of said closed rams for raising the hydraulic pressure on said one side of said rams to a level higher than the hydraulic pressure on the other side of said rams;

directing said higher pressure to a first side of a piston in a valve operating mechanism;

directing the hydraulic pressure on the other side of said rams to a second side of said piston in said valve operating mechanism; and moving said piston in said valve operating mechanism responsive to the pressure differential between one side of said closed rams and the other side of said closed rams for opening a valve controlled by said valve operating mechanism.

2. The method of claim 1 further comprising the step of compressing a spring means during the movement of said piston, said spring means being arranged to return said piston to its original piston for closing the valve controlled by said valve operating mechanism when said pressure differential is removed.

3. The method of claim 2 further comprising:

directing said higher pressure to a first side of a second piston in a second valve operating mechanism;

directing the hydraulic pressure of the other side of said rams to a second side of said second piston in said second valve operating mechanism; and moving said second piston in said second valve operating mechanism responsive to the pressure differential between one side of said closed rams and the other side of said closed rams for opening a second valve controlled by said second valve operating mechanism, said second valve controlling fluid passage through said oil well in series with the first mentioned valve.

4. The method of claim 1 further comprising closing a second set of rams in the blowout preventer stack on said one side of the first mentioned rams for trapping between said second set of rams and the first mentioned set of rams, said higher level of hydraulic pressure on the one side of said closed ram set for maintaining said valve in the open position.

5. The method of claim 4 further comprising applying hydraulic pressure to the oil well below the blowout preventer stack for operating annulus pressure responsive valves located therein.

6. The method of claim 1 further comprising:

closing a second set of rams in said blowout preventer stack for providing a fluid pressure seal from one side of said second set of rams to the other side of said second set of rams;

applying hydraulic pressure to said one side of said second set of rams for raising the hydraulic pressure on said one side of said second set of rams to a level higher than the hydraulic pressure on the other side of said rams;

directing said higher pressure to a first side of a second piston located in a quick release mechanism arranged for holding the end of a conduit string extending from the quick release mechanism upwardly to the surface of the sea;

directing the hydraulic pressure on the other side of said second set of rams to a second side of said second piston in said quick release mechanism; and moving said second piston in said quick release mechanism responsive to the pressure differential between said one side of said closed second set of rams and the other side of said closed second set of rams for operating said quick release mechanism to release the end of said conduit string.

7. The method of claim 6 wherein the applying hydraulic pressure to one side of said second set of rams comprises opening said first mentioned set of rams.

8. A method of operating a quick release mechanism arranged for holding the lower end of a conduit string which extends from the surface of the sea downwardly to the quick release mechanism located above a blowout preventer stack on the sea floor comprising:

closing a set of rams in said blowout preventer stack for providing a fluid pressure seal from one side of said rams to the other side of said rams;

applying hydraulic pressure to one side of said rams for raising the hydraulic pressure on said one side of said rams to a level higher than the hydraulic pressure on the other side of said rams;

directing said higher pressure to a first side of a piston located in said quick release mechanism;

directing the hydraulic pressure on the other side of said set of rams to a second side of said piston located in said quick release mechanism; and moving said piston in said quick release mechanism responsive to the pressure differential between said one side of said closed set of rams and the other side of said closed set of rams for operating said quick release mechanism to release the end of said conduit string.

9. A method of controlling a valve in the flow passageway of a blowout preventer stack located on a sea floor over an oil well comprising:

closing a set of rams in the blowout preventer stack for setting a reference pressure for maintaining the valve in a normal first condition;

applying hydraulic pressure to one side of said closed rams for raising the hydraulic pressure on said one side of said closed rams to a level higher than said reference pressure; and responsive to the higher level of hydraulic pressure, moving said valve from said first position to said second position.

10. The method of claim 9 further comprising closing a second set of rams on said one side of the closed set of first mentioned rams for trapping therebetween said higher level of hydraulic pressure, and maintaining said valve in said second position responsive to said higher level of hydraulic pressure trapped between said first mentioned set of rams and said second set of rams.

11. A method of operating a quick release mechanism arranged for holding the lower end of a conduit string which extends from the surface of the sea downwardly to the quick release mechanism located above a blowout preventer stack on the sea floor comprising:

closing a set of rams in the blowout preventer stack for setting a reference pressure for maintaining the end of the conduit latched into the quick release mechanism;

applying hydraulic pressure to one side of said closed rams for raising the hydraulic pressure on said one side of the closed rams to a level higher than said reference pressure; and responsive to the higher level of hydraulic pressure, operating said quick release mechanism for releasing the end of said conduit.

12. An apparatus for controlling a valve in the vicinity of a blowout preventer stack located on a sea floor over an oil well comprising:

a set of rams in the blowout preventer stack for closing and providing a fluid pressure seal from one side of said rams to the other side of said rams;

means for applying hydraulic pressure to one side of said closed rams for raising the hydraulic pressure on said one side of said rams to a level higher than the hydraulic pressure on the other side of said rams;

a valve operating mechanism for controlling said valve;

a piston in said valve operating mechanism;

means for directing said higher pressure to a first side of said piston;

means for directing the hydraulic pressure on the other side of said rams to a second side of said piston; and means in said operating mechanism for opening said valve responsive to movement of said piston in a direction responsive to the pressure differential between said one side of said closed rams and the other side of said closed rams.

13. The apparatus of claim 12 further comprising spring means on the second side of said piston arranged to be compressed during the movement of said piston under the influence of said pressure differential, said spring means for moving said piston to its original position and closing said valve when said pressure differential is removed.

14. The apparatus of claim 13 further comprising hydraulic fluid reservoir means in said means for directing said higher pressure, said fluid reservoir means for supplying hydraulic fluid to said first side of said piston responsive to hydraulic pressure on the one side of said closed rams.

15. The apparatus of claim 14 further comprising second hydraulic fluid reservoir means in said means for directing the hydraulic pressure on said other side of said rams, said second hydraulic fluid reservoir means for supplying hydraulic fluid to said second side of said piston responsive to hydraulic pressure on said other side of said closed rams.

16. The apparatus of claim 13 further comprising:

a second valve for controlling fluid passage through said oil well, said second valve being in tandem with said first mentioned valve;

a second valve operating mechanism for controlling said second valve;

a second piston in said second valve operating mechanism;

means for directing said higher pressure to a first side of said second piston;

means for directing the hydraulic pressure on the other side of said rams to a second side of said second piston; and means in said second operating mechanism for opening said second valve responsive to movement of said second piston in a direction responsive to the pressure differential between said one side of said closed rams and the other side of said closed rams.

17. The apparatus of claim 12 further comprising a second set of rams in the blowout preventer stack located on said one side of the first mentioned rams for closing and trapping therebetween, said higher level of hydraulic pressure for maintaining said valve in the open position.

18. The apparatus of claim 17 further comprising a testing string in the oil well below the blowout preventer stack, and annulus pressure operated tools in said testing string.

19. The apparatus of claim 17 further comprising means in said higher pressure directing means for compensating for various spacing between said first and second set of rams.

20. The apparatus of claim 12 further comprising:

a second set of rams in the blowout preventer stack for closing and providing a fluid pressure seal from one side of said second set of rams to the other side of said second set of rams;

means for applying hydraulic pressure to said one side of said second set of rams for raising the hydraulic pressure on said one side of said second set of rams to a level higher than the hydraulic pressure on the other side of said rams;

a quick release mechanism arranged for holding the end of a conduit string extending from the quick release mechanism upwardly to the surface of the sea;

a second piston in said quick release mechanism;

means for directing said higher pressure to a first side of said second piston;

means for directing the hydraulic pressure on the other side of said second set of rams to the second side of said second piston; and means in said quick release mechanism for releasing the end of said conduit responsive to the movement of said second piston in a direction responsive to the pressure differential between said one side of said closed second set of rams and the other side of said closed second set of rams.

21. The apparatus of claim 20 further comprising means in said higher pressure directing means for compensating for various spacing between said first and second set of rams.

22. A quick release apparatus arranged for holding the lower end of a conduit string which extends from the surface of the sea downwardly to the quick release apparatus located above a blowout preventer stack on the sea floor comprising:

a set of rams in the blowout preventer stack for closing and providing a fluid pressure seal from one side of said rams to the other side of said rams;

means for applying hydraulic pressure to said one side of said rams for raising the hydrostatic pressure on said one side of said rams to a level higher than the hydraulic pressure on the other side of said rams;

a piston in said quick release apparatus;

means for directing said higher pressure to a first side of said piston;

means for directing the hydraulic pressure on the other side of said rams to the second side of said piston; and means in said quick release apparatus for releasing the end of said conduit responsive to the movement of said second piston in a direction responsive to the pressure differential between said one side of said closed set of rams and the other side of said closed set of rams.

23. The apparatus of claim 22 wherein said lower end of said conduit string includes teeth extending radially outwardly from said conduit periphery, said apparatus further comprising:

a plurality of inwardly biased latch blocks having radially inwardly directed teeth to prevent the passing of the teeth on the conduit end when said latch blocks are in their inmost position; and mandrel means attached to said piston, said mandrel means being slidably moved from a first position to a second position when said piston moves from a first position to a second position responsive to a pressure differential between said one side of said closed set of rams and the other side of said closed set of rams, said mandrel means further preventing said latch blocks from moving outwardly when said mandrel means is in its first position and said mandrel means allowing said latch blocks to move outwardly releasing the teeth on the end of said conduit when said mandrel means is in its second position.

24. The apparatus of claim 23 including alignment means for coacting with means in the end of said conduit for circumferentially aligning said conduit with said apparatus during the last downward increment of travel of said conduit into said quick release apparatus, and for transmitting rotary movement of said conduit to said apparatus when said alignment means coacts with said means in the end of said conduit.

25. The apparatus of claim 22 further comprising fluid pressure conductor means having a pressure port and a fluid pressure passageway extending from said piston to a point below said ram set for communicating pressure from below said ram set to said first side of said piston, and an exhaust pressure passageway for communicating fluid pressure between said second side of said piston and a point above said ram set.

26. The apparatus of claim 25 further comprising means for changing the location of the pressure port in said fluid pressure passage for changing the spacing from said piston to a point below said ram set.

27. An apparatus for controlling a valve in the flow passageway of a blowout preventer stack located on a sea floor over an oil well comprising:

a set of rams in the blowout preventer stack for closing and setting a reference pressure;

valve operating means including means for maintaining the valve in a first normal position responsive to said reference pressure;

means for applying hydraulic pressure to one side of said closed rams for raising the hydraulic pressure on said one side of said closed rams to a level higher than said reference pressure; and means in said valve operating means for moving said valve from said first position to said second position responsive to said higher level of hydraulic pressure.

28. A quick release apparatus arranged for holding the lower end of a conduit string which extends from the surface of the sea downwardly to the quick release apparatus located above a blowout preventer stack on the sea floor comprising:

a set of rams in the blowout preventer stack for closing and setting a reference pressure;

operating means including means for latching the end of said conduit responsive to said reference pressure;

means for applying hydraulic pressure to one side of said closed rams for raising the hydraulic pressure on said one side of said closed rams to a level higher than said reference pressure; and means in said operating means for unlatching the end of said conduit responsive to the higher level of said hydraulic pressure.

29. A subsea test tree apparatus for use in a blowout preventer stack having a plurality of closeable sets of rams therein, and a means for applying hydraulic fluid pressure to a selected side of a set of said closeable rams, and apparatus comprising:

a tubular outer housing having an inner bore therethrough and a chamber in the walls thereof;

an activating pressure passageway longitudinally through the wall of the outer housing having a first lateral port for providing fluid communication between the activating pressure passageway and the area exterior of said outer housing in said blowout preventer stack, and a second lateral port for providing fluid communication between the activating pressure passageway and the upper portion of said chamber;

an exhaust pressure passageway longitudinally through the wall of the outer housing having a third lateral port for providing fluid communication between the exhaust pressure passageway and the area exterior of said outer housing in said blowout preventer stack and spaced from said first lateral port to be isolated therefrom when a selected set of rams is closed between said first and third lateral ports, said exhaust pressure passageway also including a fourth lateral port for providing fluid communication between said exhaust pressure passageway and the lower portion of said chamber;

piston means dividing said chamber and arranged for movement in said chamber intermediate said third and fourth ports responsive to a pressure differential between the upper and lower portions of said cylinder;

valve means in said inner bore for controlling fluid flow therethrough; and valve operating means connecting said piston means to said valve means for closing said inner bore to fluid flow when said piston means is in a first position, and for opening the inner bore to fluid flow when said piston means moves in a first direction to a second position.

30. The apparatus of claim 29 wherein said tubular housing includes means for changing the location of said first port and said third port for positioning said first and third ports on either side of said selected set of rams in the blowout preventer stack.

31. The apparatus of claim 29 further comprising spring means in said chamber urging said piston in a second direction opposite to said first direction for returning said piston to said first position when said pressure differential is removed.

32. The apparatus of claim 29 wherein said tubular outer housing includes a second chamber, said activating pressure passageway includes a fifth lateral port for providing fluid communication between said activating pressure passageway and the upper portion of said second cylinder, and said exhaust pressure passageway includes a sixth lateral port for providing fluid communication between said exhaust pressure passageway and the lower portion of said second cylinder, said apparatus further comprising:

second piston means dividing said second chamber and arranged for movement in said chamber intermediate said fifth and sixth ports responsive to a pressure differential between the upper and lower portions of said cylinder;

second valve means in said inner bore and in series with said first valve means for opening and closing said inner bore; and second operating means connecting said second piston means to said second valve means for closing said inner bore when said piston is in a first position, and for opening said inner bore when said piston means moves in a first direction to a second position.

33. The apparatus of claim 29 further comprising first hydraulic fluid reservoir means in said activating pressure passageway in said tubular housing for supplying hydraulic fluid to the lower portion of said activating pressure passageway and the portion of said cylinder above said piston means responsive to hydraulic fluid pressure in the upper portion of said activating pressure passageway; and second hydraulic fluid reservoir means in said exhaust pressure passageway in said tubular housing for supplying hydraulic fluid to the lower portion of said exhaust pressure passageway and the portion of said cylinder below said piston means responsive to hydraulic fluid pressure in the upper portion of said exhaust pressure passageway.

34. The apparatus of claim 33 wherein said activating pressure passageway includes an activating fluid cylinder in the walls of said outer tubular housing, one end of said activating cylinder communicating with the upper portion of said activating pressure passageway and the other end of said activating cylinder communicating with the lower portion of said activating pressure passageway; and said exhaust pressure passageway includes an exhaust fluid cylinder in the walls of said outer tubular housing, one end of said exhaust cylinder communicating with the upper portion of said exhaust pressure passageway and the other end of said exhaust cylinder communicating with the lower portion of said exhaust pressure passageway; said apparatus further comprising:

an activating floating piston dividing said activating cylinder and arranged for being exposed to well fluid pressure on one side from said one end of said activating cylinder;

hydraulic fluid on the other side of said activating piston in said other end portion of said activating cylinder, and in the lower portion of said activating pressure passageway;

an exhaust floating piston dividing said exhaust cylinder and arranged for being exposed to well fluid pressure on one side from said one end of said exhaust cylinder; and hydraulic fluid on the other side of said exhaust piston in said other end portion of said exhaust cylinder, and in the lower portion of said exhaust pressure passageway and said chamber.

35. The apparatus of claim 34 further comprising adapter means in the wall of said outer tubular housing above said activating cylinder and said exhaust cylinder for communicating fluid pressure between said activating pressure passageway and said activating cylinder, and for communicating fluid pressure between said exhaust pressure passageway and said exhaust cylinder respectively; said adaptor means including means for orienting said adapter means.

36. The apparatus of claim 29 wherein said outer tubular housing includes a release chamber in the walls thereof and further comprises:

a release pressure passageway longitudinally through the wall of the outer housing having a fifth lateral port for providing fluid communication between the activating pressure passageway and the area exterior of said outer housing in said blowout preventer stack and spaced from said first lateral port to be isolated therefrom when a selected set of rams is closed between said first and fifth ports, said release pressure passageway communicating with a sixth port in the lower portion of said release chamber;

a release exhaust passageway through the walls of the outer housing for providing fluid communication between the upper portion of said release chamber and an area exterior of said outer housing at a point spaced from said fifth port to isolate said area from said fifth port when said selected set of rams is closed;

release piston means dividing said release chamber and arranged for movement in said chamber intermediate said sixth port and said release exhaust passageway responsive to a pressure differential between the upper and lower portion of said release chamber;

a release mechanism in said apparatus for latching and unlatching the end of a conduit in said inner bore; and release operating means connecting said release piston means and said release mechanism for operating said release mechanism to latch said conduit end when said release piston means is in a first position, and for operating said release mechanism to unlatch said conduit end when said piston means moves in a first direction to a second position.

37. The apparatus of claim 36 wherein said tubular housing includes means for changing the location of said first port and said fifth port to position said first and fifth ports on either side of said selected set of rams in the blowout preventer stack.

38. The apparatus of claim 36 wherein the lower end of the conduit string includes teeth extending radially outwardly from said conduit periphery, said apparatus further comprising:

a plurality of inwardly biased latch blocks having radially inwardly directed teeth to prevent the passing of the teeth on the conduit end when said latch blocks are in their inmost position; and mandrel means attached to said release piston means, said mandrel means being slidably movable from a first position to a second position when said release piston means moves from said first position to said second position, said mandrel means further preventing said latch blocks from moving outwardly when said mandrel means is in its first position and said mandrel means allowing said latch blocks to move outwardly releasing the teeth on the end of said conduit when said mandrel means is in its second position.

39. The apparatus of claim 38 including alignment means for coacting with means in the end of said conduit for circumferentially aligning said conduit with said latch blocks during the last downward increment of travel of said conduit into said inner bore, and for transmitting rotary movement of said conduit to said tubular housing when said alignment means coacts with said means in the end of said conduit.

* * * * *

UNITED STATES PATENT AND TRADEMARK OFFICE

CERTIFICATE OF CORRECTION

PATENT NO. : 4,116,272

DATED : September 26, 1978

INVENTOR(S) : Burchus Q. Barrington

It is certified that error appears in the above-identified patent and that said Letters Patent are hereby corrected as shown below:

Column 3, line 47, "location" should be --located--

Column 4, line 65, "struck" should be --stuck--

Column 4, line 67, "struck" should be --stuck--

Column 6, line 61, "hand-off" should be --hang-off--

Column 10, line 35, the number "112" should be --122--

IN THE CLAIMS

Claim 2, line 21, "piston", second occurrence, should be --position--

Claim 29, line 8, "and" should be --said--

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*